US010255871B2

(12) United States Patent
Oh

(10) Patent No.: US 10,255,871 B2
(45) Date of Patent: Apr. 9, 2019

(54) DISPLAY DEVICE INCLUDING A MUX TO VARY VOLTAGE LEVELS OF A SWITCHING CIRCUIT USED TO DRIVE A DISPLAY PANEL

(71) Applicant: LG DISPLAY CO., LTD., Seoul (KR)

(72) Inventor: Zonggun Oh, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 242 days.

(21) Appl. No.: 14/949,502

(22) Filed: Nov. 23, 2015

(65) Prior Publication Data

US 2016/0189657 A1 Jun. 30, 2016

(30) Foreign Application Priority Data

Dec. 31, 2014 (KR) ..... 10-2014-0195747

(51) Int. Cl.
*G09G 3/36* (2006.01)

(52) U.S. Cl.
CPC ..... *G09G 3/3688* (2013.01); *G09G 3/3614* (2013.01); *G09G 2300/0814* (2013.01); *G09G 2310/0289* (2013.01); *G09G 2310/0297* (2013.01); *G09G 2320/0666* (2013.01); *G09G 2330/021* (2013.01)

(58) Field of Classification Search
None
See application file for complete search history.

(56) References Cited

U.S. PATENT DOCUMENTS 6,249,270 B1 * 6/2001 Ito ..... G09G 3/3688 345/100
2003/0085885 A1 5/2003 Nakayoshi et al.
2004/0125065 A1 * 7/2004 Park ..... G09G 3/20 345/92
2005/0134541 A1 * 6/2005 Jang ..... G09G 3/3688 345/94
2008/0297673 A1 12/2008 Takahashi
2010/0289786 A1 11/2010 Tanaka et al.
2011/0001749 A1 * 1/2011 Min ..... G09G 3/3688 345/214
2014/0204069 A1 * 7/2014 Chien ..... G09G 3/3291 345/212

FOREIGN PATENT DOCUMENTS

EP 2006831 A1 12/2008
TW 201409447 A 3/2014

* cited by examiner

*Primary Examiner* — Christopher R Lamb
(74) *Attorney, Agent, or Firm* — Dentons US LLP

(57) ABSTRACT

A display device includes a display panel including a plurality of data lines, a data driver to supply a source voltage to each data line through a source line, a switching circuit to connect each data line to the source line, and a multiplexer controller to produce a control signal operating the switching circuit and vary a voltage level of the control signal depending on the source voltage.

12 Claims, 6 Drawing Sheets

DISPLAY DEVICE INCLUDING A MUX TO VARY VOLTAGE LEVELS OF A SWITCHING CIRCUIT USED TO DRIVE A DISPLAY PANEL

CROSS REFERENCE TO RELATED APPLICATIONS

This application claims the benefit of Korea Patent Application No. 10-2014-0195747 filed on Dec. 31, 2014, the entire contents of which is incorporated by reference for all purposes as if fully set forth herein.

BACKGROUND

Field of the Disclosure

Embodiments of the disclosure relate to a display device.

Discussion of the Related Art

Examples of a flat panel display include a liquid crystal display (LCD), a field emission display (FED), a plasma display panel (PDP), and an organic light emitting diode (OLED) display. In the flat panel display, data lines and gate lines are arranged to cross each other, and each crossing of the data lines and the gate lines defines a pixel. The plurality of pixels are formed on a display panel of the flat panel display in a matrix form. The flat panel display supplies a video data voltage to the data lines and sequentially supplies a gate pulse to the gate lines, thereby driving the pixels. The flat panel display supplies the video data voltage to the pixels of a display line, to which the gate pulse is supplied, and sequentially scans all of the display lines through the gate pulse, thereby displaying video data.

The data voltage supplied to the data lines is produced in a data driver and is supplied to the pixels through each channel of the data driver. A multiplexer switching circuit is used to simplify the data driver. The multiplexer switching circuit provides the channels of the data driver for the plurality of data lines and can reduce the number of channels.

Multiplexer signals controlling the multiplexer switching circuit generally use a gate high voltage and a gate low voltage. Because the number of channels of the data driver increases as a resolution of the display device increases, power consumption resulting from the multiplexer signals controlling the multiplexer switching circuit increases.

SUMMARY

In one aspect of the invention, there is a display device comprising a display panel including a data line, a data driver to supply a source voltage to the data line through a source line, a switching circuit to connect the data line to the source line, and a multiplexer controller to produce a control signal operating the switching circuit and vary a voltage level of the control signal depending on the source voltage.

In another aspect of the invention, there is method of driving a display device including a display panel with a data line, the method comprising: supplying a source voltage by a data driver to the data line through a source line; connecting the data line to the source line with a switching circuit; generating a control signal by a multiplexer controller to operate the switching circuit and vary a voltage level of the control signal depending on the source voltage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. A detailed description of known arts will be omitted if it is determined that the arts can mislead the embodiments of the invention.

Figure 1:
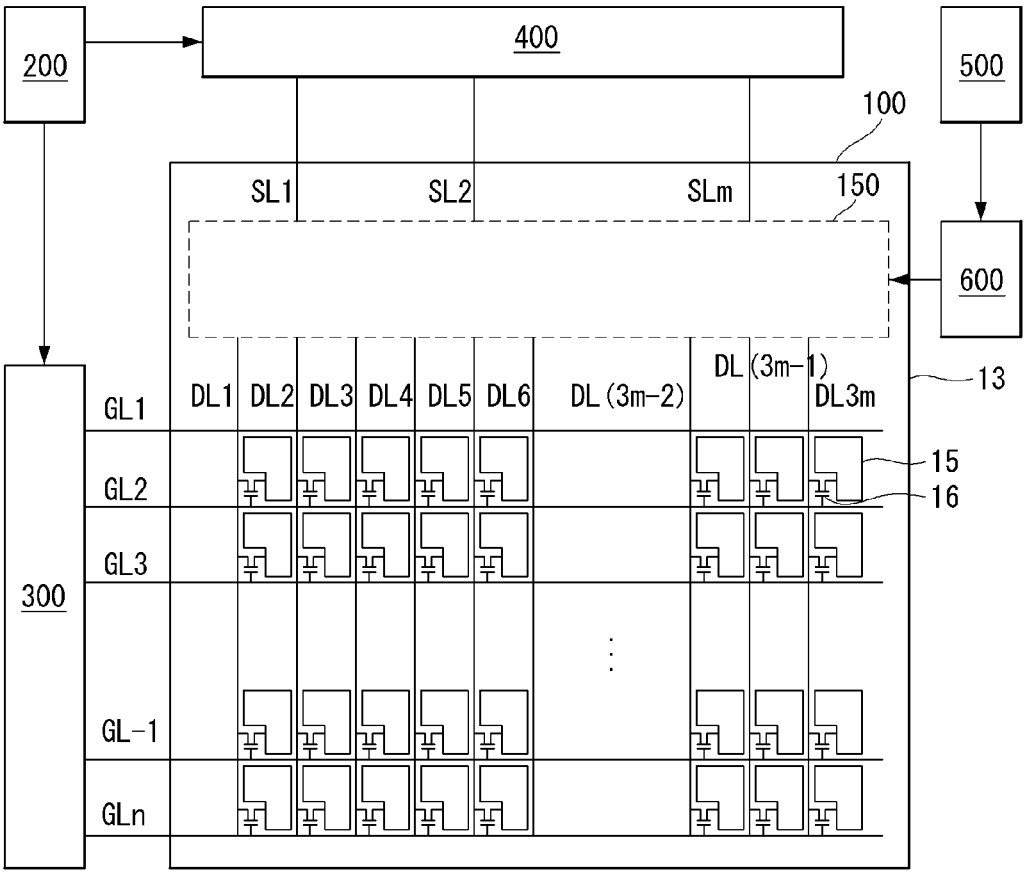
FIG. 1 illustrates a display device according to an exemplary embodiment of the invention.

FIG. 1 illustrates a display device according to an exemplary embodiment of the invention.

Referring to FIG. 1, the display device according to the embodiment of the invention includes a display panel 100, a timing controller 200, a gate driver 300, a data driver 400, a power module 500, and a multiplexer (MUX) controller 600.

Figure 2:
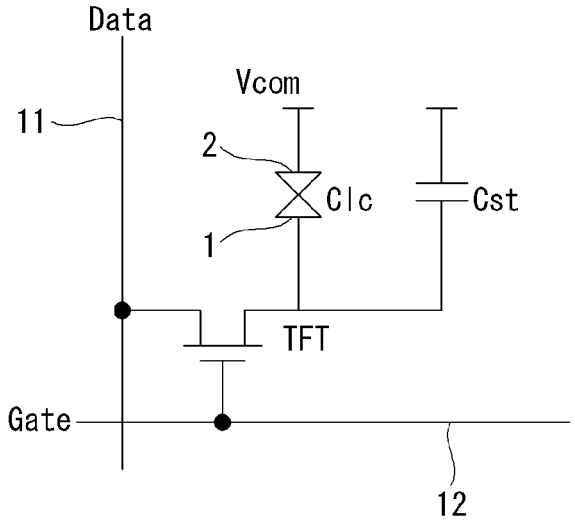
FIG. 2 shows an example of a pixel shown in FIG. 1.

The display panel 100 includes a pixel array, in which pixels are arranged in a matrix form, and displays input image data. The pixel array includes a thin film transistor (TFT) array formed on a lower substrate, a color filter array formed on an upper substrate, and liquid crystal cells Clc formed between the lower substrate and the upper substrate. As shown in FIG. 2, for each pixel, the TFT array includes data lines DL, gate lines GL crossing the data lines DL, thin film transistors (TFTs) respectively formed at crossings of the data lines DL and the gate lines GL, pixel electrodes 1 connected to the TFTs, storage capacitors Cst, and the like. The color filter array includes black matrixes and color filters. A common electrode 2 may be formed on the lower substrate or the upper substrate. Each liquid crystal cell Clc is driven by an electric field between the pixel electrode 1, to which a data voltage is supplied, and the common electrode 2, to which a common voltage Vcom is supplied.

The timing controller 200 receives digital video data RGB and timing signals, such as a vertical sync signal Vsync, a horizontal sync signal Hsync, a data enable signal DE, and a main clock CLK, from an external host. The timing controller 200 transmits the digital video data RGB to source (or data) driver integrated circuits (ICs). The timing controller 200 generates a source timing control signal for controlling operation timing of the source driver ICs and a gate timing control signal for controlling operation timing of the gate driver 300 using the timing signals Vsync, Hsync, DE, and CLK.

The gate driver 300 outputs a gate pulse Gout using the gate timing control signal. The gate timing control signal includes a gate start pulse GSP, a gate shift clock GSC, and a gate output enable signal GOE. The gate start pulse GSP indicates a start gate line, to which the gate driver 300 outputs a first gate pulse Gout. The gate shift clock GSC is a clock for shifting the gate start pulse GSP. The gate output enable signal GOE sets an output period of the gate pulse Gout.

Figure 3:
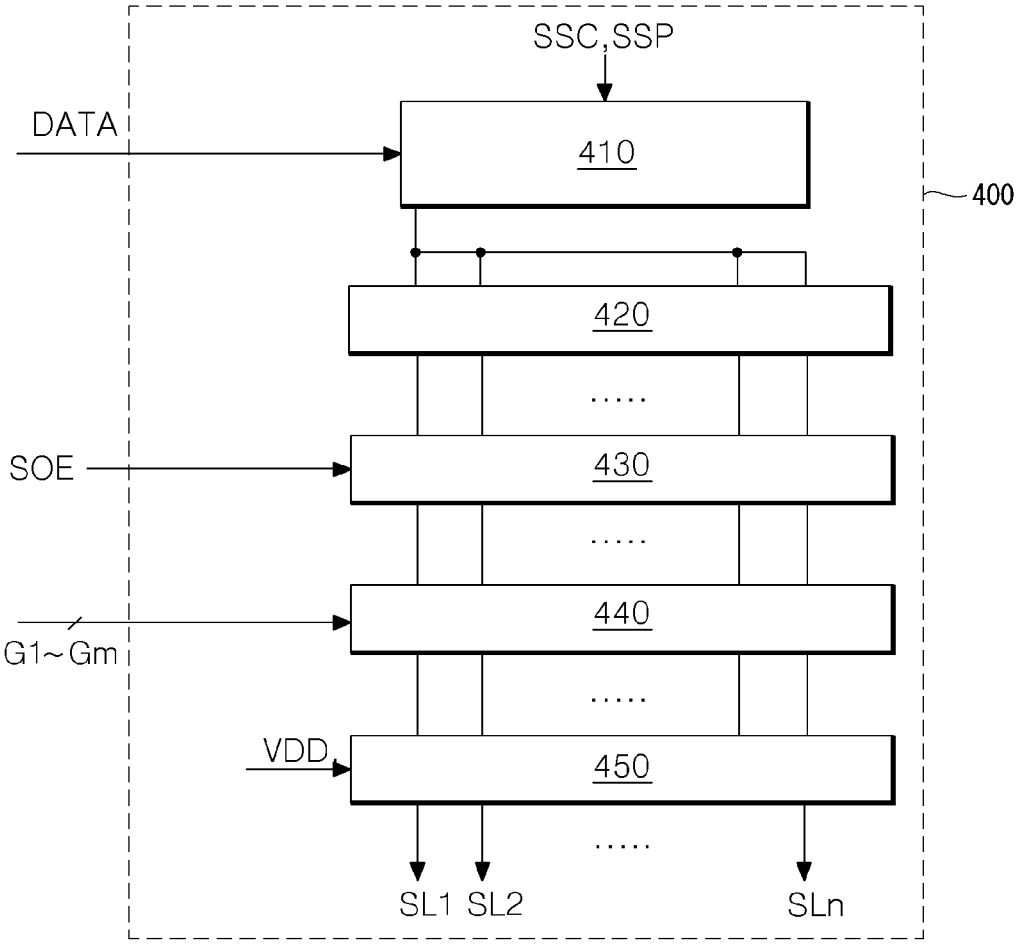
FIG. 3 shows an example of a data driver.

As shown in FIG. 3, the data driver 400 includes a register 410, a first latch 420, a second latch 430, a digital-to-analog converter (DAC) 440, and an output unit 450. The register 410 samples RGB digital video data bit of an input image in response to data control signals SSC and SSP received from the timing controller 200 and supplies it to the first latch 420. The first latch 420 samples and latches the RGB digital video data bit in response to the clock sequentially received from the register 410. Then, the first latch 420 simultaneously outputs the latched RGB digital video data to the second latch 430. The second latch 430 latches the RGB digital video data received from the first latch 420 and simultaneously outputs the latched data in response to a source output enable signal SOE in synchronization with the second latches 430 of other source driver ICs. The DAC 440 converts the digital video data input from the second latch 430 along with a gamma compensation voltage G and generates an analog video data voltage. The output unit 450 supplies the analog data voltage output from the DAC 440 to the data lines SL during a low logic period of the source output enable signal SOE. The output unit 450 may be implemented as an output buffer for outputting the data voltage using a low potential voltage and a driving voltage VDD received through a high potential input terminal.

The power module 500 receives VCC, VDD, DDVDH, DDVDL, etc. and outputs VGH, VGL, etc., explained below. The power module 500 generates first to sixth voltage levels V1 to V6 corresponding to voltage levels of first to sixth control signals MUX1 to MUX6.

VGH is a high level voltage of the gate pulse, and VGL is a low level voltage of the gate pulse. Positive and negative gamma reference voltages are also supplied to the data driver 400.

A switching circuit 150 (shown in FIG. 1) divides a data voltage, which the data driver 400 receives through one source line, into three data lines.

Figure 4:
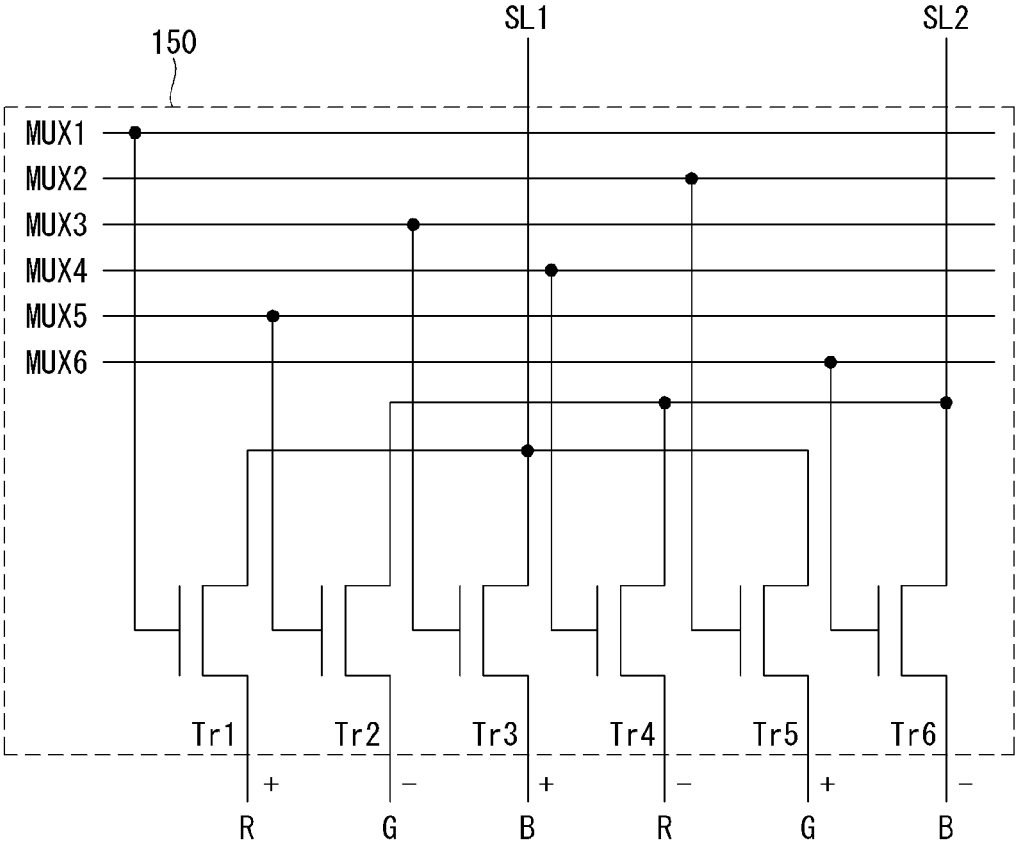
FIG. 4 illustrates a structure of a switching unit according to an exemplary embodiment of the invention.
Figure 5:
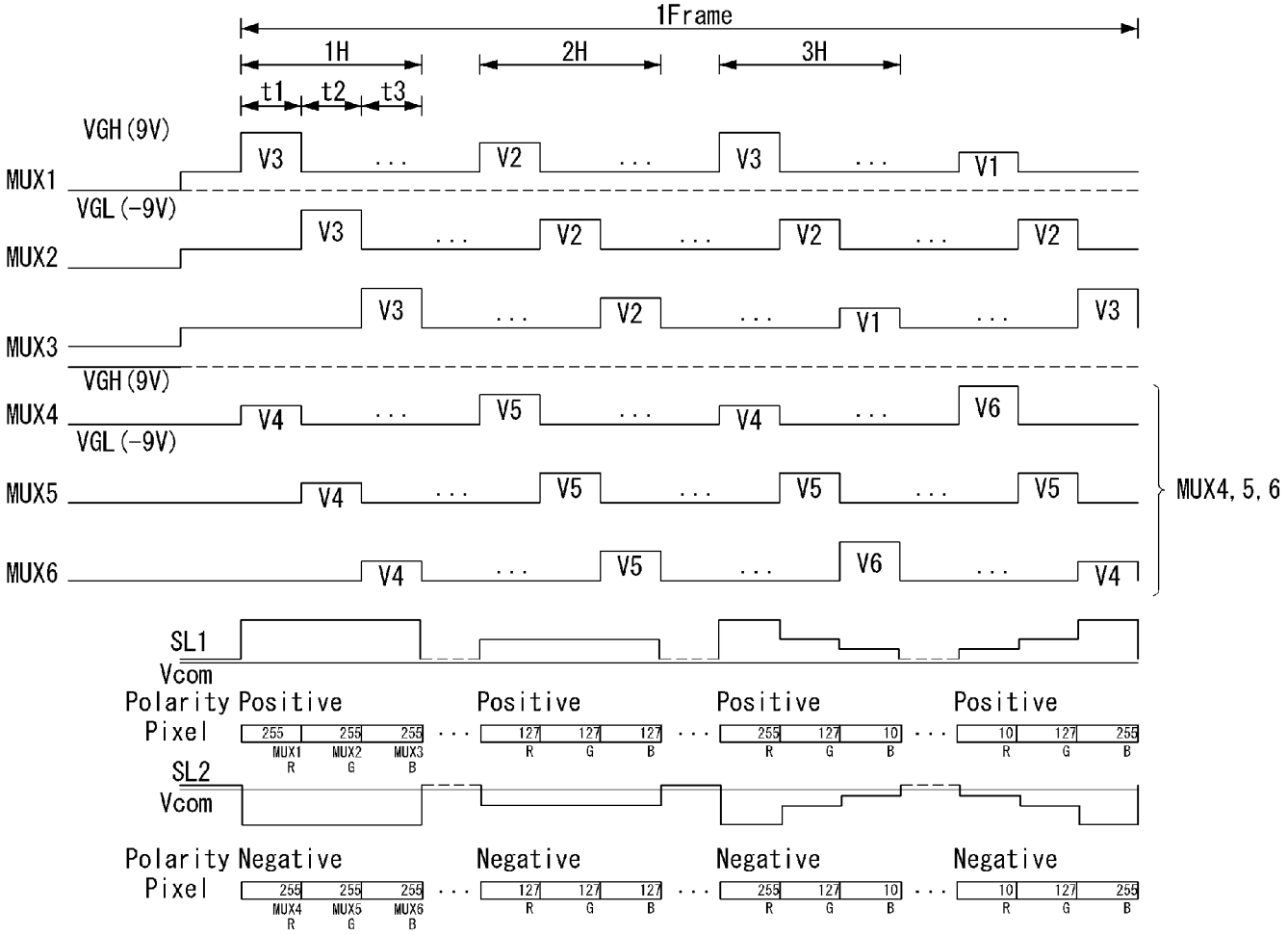
FIG. 5 illustrates timing and a voltage level of a control signal according to an exemplary embodiment of the invention.

FIG. 4 illustrates a structure of the switching circuit 150 according to the embodiment of the invention, and FIG. 5 illustrates timings and voltage levels of first to sixth control signals MUX1 to MUX6 according to the embodiment of the invention.

Referring to FIGS. 4 and 5, the switching circuit 150 according to the embodiment of the invention includes first to sixth switching elements Tr1 to Tr6 respectively operating in response to the first to sixth control signals MUX1 to MUX6.

Each of the first to third control signals MUX1 to MUX3 is output during ⅓ of a horizontal period t, so as to scan three data lines during one horizontal period 1H. Each of the fourth to sixth control signals MUX4 to MUX6 is output during ⅓ of a horizontal period in the same manner as the first to third control signals MUX1 to MUX3.

A first source line SL1 time-division provides red data R, green data G, and blue data B during one horizontal period 1H.

During a first period t1, the first switching element Tr1 supplies the red data R received through the first source line SL1 to a first data line DL1 in response to the first control signal MUX1. And at the same time, the fourth switching element Tr4 supplies the red data R received through a second source line SL2 to a fourth data line DL4 in response to the fourth control signal MUX4.

During a second period t2, the second switching element Tr2 supplies the green data G received through the second source line SL2 to a second data line DL2 in response to the fifth control signal MUX5. And at the same time, the fifth switching element Try supplies the green data G received through the first source line SL1 to a fifth data line DL5 in response to the second control signal MUX2.

During a third period t3, the third switching element Tr3 supplies the blue data B received through the first source line SL1 to a third data line DL3 in response to the third control signal MUX3. And at the same time, the sixth switching element Tr6 supplies the blue data B received through the second source line SL2 to a sixth data line DL6 in response to the sixth control signal MUX6.

During one frame period, the first source line SL1 outputs a positive data voltage, and the second source line SL2 outputs a negative data voltage. Because the adjacent first to sixth data lines DL1 to DL6 are alternately connected to the first source line SL1 and the second source line SL2, a horizontal 1 dot inversion drive is performed.

The multiplexer controller 600 varies the voltage levels of the first to sixth control signals MUX1 to MUX6 depending on a level of the data voltage. For example, the multiplexer controller 600 may select the control signal MUX having one of first to third voltage levels V1 to V3. This is described in more detail below.

Figure 6:
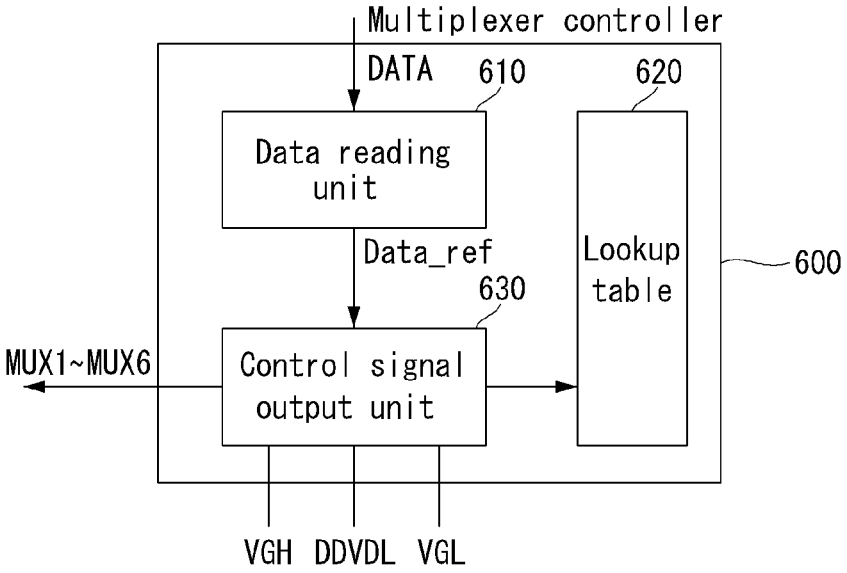
FIG. 6 illustrates a configuration of a multiplexer controller according to an exemplary embodiment of the invention.

As shown in FIG. 6, the multiplexer controller 600 includes a data reading unit 610, a lookup table 620, and a control signal output unit 630.

Figure 7:
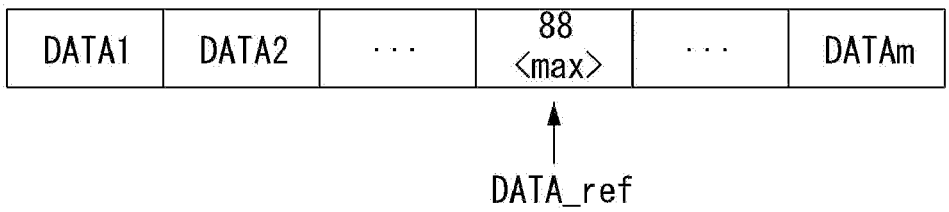
FIG. 7 illustrates an example of selecting reference data according to an exemplary embodiment of the invention.

The data reading unit 610 reads the size of image data on a per line basis and detects reference data among the image data. As shown in FIG. 7, one line of image data includes first image data DATA1 supplied to the first source line SL1 to mth image data DATAm supplied to an mth source line SLm. The first image data DATA1 to the mth image data DATAm may be one of the red data R, the green data G, and the blue data B. Namely, all of image data belonging to one line are data of the same color. The data reading unit 610 regards image data having a maximum value among image data, which is simultaneously output to the source lines, as reference data DATA_ref. For example, as shown in FIG. 7, when image data representing a gray level '88' among data of a horizontal line has a maximum value, the data reading unit 610 regards the image data of the gray level '88' as the reference data DATA_ref.

The lookup table 620 stores the reference data DATA_ref and the voltage level of the control signal MUX so that size of the reference data DATA_ref and the voltage level of the control signal MUX correspond to each other.

The control signal output unit 630 receives the reference data DATA_ref detected by the data reading unit 610 and selects the voltage level corresponding to the reference data DATA_ref from the lookup table 620. For example, as shown in FIG. 7, when the reference data DATA_ref is the image data representing the gray level '88', the control signal output unit 630 selects the second voltage level corresponding to the gray level '88' from the lookup table 620.

The control signal output unit 630 may receive the voltage corresponding to each voltage level from the power module 500, so as to output the control signal corresponding to the voltage level selected from the lookup table 620. Namely, the control signal output unit 630 is connected to a voltage source of the previously set first to third voltage levels V1 to V3 and searches the voltage level corresponding to the reference data DATA_ref. The control signal output unit 630 connects the voltage source of the corresponding voltage level to the switching circuit 150, as shown in FIG. 1.

The following Table 1 shows an example of a lookup table.

TABLE 1

| DATA_ref (gray level) | Sout (Volts) | MUX level |
|---|---|---|
| 0 | 0.3 | 5 |
| . . . | . . . | |
| 12 | 0.97 | |
| 13 | 1.00 | 7 |
| . . . | . . . | |
| 88 | 2.13 | |
| . . . | . . . | |
| 178 | 2.996 | |
| 179 | 3.0 | 9 |
| . . . | . . . | |
| 255 | 4.7 | |

As indicated by the above Table 1, the voltage level of the control signal is proportional to size of the reference data. A relationship between the voltage level of the control signal and the size of the reference data is described below.

As the size of the reference data increases, a voltage level of a source voltage Sout the data driver 400 outputs to display the corresponding reference data increases. The source voltage Sout is a voltage output through source electrodes of the first to sixth switching elements Tr1 to Tr6 of the switching circuit 150. Namely, as the size of the reference data increases, source voltages of the first to sixth switching elements Tr1 to Tr6 increase.

Turn-on voltages of the first to sixth switching elements Tr1 to Tr6 correspond to a condition where a gate-to-source voltage Vgs is equal to or greater than a threshold voltage Vth. Namely, because a difference between a gate voltage Vg and a source voltage Sout has to be greater than the threshold voltage Vth, the gate voltage Vg has to be greater than a sum of the source voltage Sout and the threshold voltage Vth. If threshold voltages Vth of the first to sixth switching elements Tr1 to Tr6 are less than 4V, the first to sixth switching elements Tr1 to Tr6 may be turned on when the gate voltage Vg is greater than a sum of the source voltage Sout and the threshold voltage Vth of 4V.

An amount of power consumption is proportional to a current and a voltage, and the current is proportional to a change in the voltage over time. Namely, because the amount of power consumption is proportional to the change in the voltage over time, the power consumption may be reduced when the voltage level of the control signal decreases. When the voltage level of the control signal corresponding to the gate voltages of the first to sixth switching elements Tr1 to Tr6 varies, power consumption required to operate the switching circuit 150 may be reduced. A related art used a level of a gate high voltage having a large operation margin to operate the first to sixth switching elements Tr1 to Tr6 with respect to all of the source voltages Sout of the first to sixth switching elements Tr1 to Tr6. On the other hand, because the embodiment of the invention varies the voltage level of the control signal based on image data, which is a reference to generate the source voltage Sout, the embodiment of the invention may operate the switching circuit 150 using a voltage less than the gate high voltage based on the image data.

When the source voltage Sout is a positive voltage, a first low potential voltage level for turning off the first to sixth switching elements Tr1 to Tr6 may select a voltage (i.e., a negative voltage having an absolute value less than an absolute value of a gate low voltage VGL) greater than the gate low voltage VGL. In the related art, a low potential voltage level of the control signal for turning off the first to sixth switching elements Tr1 to Tr6 was set considering that the source voltage Sout may be a negative voltage. When the source voltage Sout is a positive voltage, the first to sixth switching elements Tr1 to Tr6 may be turned off even if a negative voltage having an absolute value less than an absolute value of the source voltage Sout of the negative voltage is used. Thus, the embodiment of the invention may reduce a change in the voltage level of the control signal using the negative voltage having a small absolute value even when the source voltage Sout is a positive voltage.

In the lookup table of the above Table 1, a magnitude of the source voltage Sout and the threshold voltage of the switching elements may vary depending on display panels. Namely, the voltage level of the control signal indicated in the above Table 1 is merely an example and may be variously designed depending on the magnitude of the source voltage or the threshold voltage.

Table 1 indicates the voltage level of the control signal when the source voltage Sout is a positive voltage. The following Table 2 indicates the voltage level of the control signal corresponding to image data when the source voltage Sout is a negative voltage.

TABLE 2

| DATA_ref (gray level) | Sout (Volts) | MUX level |
|---|---|---|
| 0 | −0.3 | 1 |
| . . . | . . . | |
| 12 | −0.97 | |
| 13 | −1.00 | 3 |
| . . . | . . . | |
| 88 | −2.13 | |
| . . . | . . . | |
| 178 | −2.996 | |
| 179 | −3.0 | 5 |
| . . . | . . . | |
| 255 | −4.7 | |

When the source voltage Sout is a negative voltage, the source voltage based on a reference voltage has the same absolute value as the source voltage Sout indicated in Table 1 and has a polarity opposite the source voltage Sout indicated in Table 1. Thus, when the source voltage Sout is a negative voltage, a range of the reference voltage may be the same as Table 1. Even when the source voltage Sout is a negative voltage, the gate voltage Vg for turning on the switching element has to be greater than a difference between the threshold voltage Vth and the source voltage Sout. Namely, when the source voltage Sout is a negative voltage, the switching element may be turned on using a voltage level of a small value of the gate voltage Vg as an absolute value of the source voltage Sout increases. Thus, when the source voltage Sout is a negative voltage, the fourth voltage level V4 having a minimum voltage level may be selected when the absolute value of the source voltage Sout is at a maximum range. Further, when the absolute value of the source voltage Sout is at a minimum range, the sixth voltage level V6 having a maximum voltage level may be selected. Further, when the absolute value of the source voltage Sout is at a middle range, the fifth voltage level V5 may be selected. For example, the fourth voltage level V4 may be 1 V, the fifth voltage level V5 may be 3 V, and the sixth voltage level V6 may be 5 V.

An example of selecting the voltage level of the control signal depending on a polarity and a voltage level of the source voltage Sout is described with reference to FIG. 5.

In FIG. 5, the first source line SL1 outputs the positive voltage, and the second source line SL2 outputs the negative voltage. During a first horizontal period 1H, all of red data R, green data G, and blue data B output through the first source line SL1 represent a high gray level. Hence, all of the first control signal MUX1, the fifth control signal MUX5, and the third control signal MUX3 respectively controlling the first switching element Tr1, the fifth switching element Tr5, and the third switching element Tr3 connected to the first source line SL1 have the third voltage level V3. Similar to this, the fourth switching element Tr4, the second switching element Tr2, and the sixth switching element Tr6 connected to the second source line SL2 each have the fourth voltage level V4.

During a second horizontal period 2H, all of data output through the first source line SL1 and the second source line SL2 represents a middle gray level. Hence, all of the first control signal MUX1, the fifth control signal MUX5, and the third control signal MUX3 respectively controlling the first switching element Tr1, the fifth switching element Tr5, and the third switching element Tr3 connected to the first source line SL1 have the second voltage level V2. Similar to this, the fourth switching element Tr4, the second switching element Tr2, and the sixth switching element Tr6 connected to the second source line SL2 each have the fifth voltage level V5.

During a third horizontal period 3H, the first source line SL1 outputs red data R of a high gray level, green data G of a middle gray level, and blue data B of a low gray level. Hence, in an initial stage of the third horizontal period 3H, the first source line SL1 successively outputs the first control signal MUX1 of the third voltage level V3, the fifth control signal MUX5 of the second voltage level V2, and the third control signal MUX3 of the first voltage level V1. Further, during the third horizontal period 3H, the second source line SL2 outputs the fourth control signal MUX4 of the fourth voltage level V4, the second control signal MUX2 of the fifth voltage level V5, and the sixth control signal MUX6 of the sixth voltage level V6.

As described above, the embodiment of the invention selectively varies the voltage level of the control signal controlling the switching circuit; and thus, can reduce the power consumption compared to the method always using the voltage having a high voltage level.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device, comprising:

a display panel including a plurality of data lines;

a gate driver to supply, to the display panel, a gate pulse having a first gate voltage and a second gate voltage lower than the first gate voltage;

a data driver to supply a source voltage to each data line through a source line, wherein the data driver includes a digital-to-analog converter (DAC) that converts input digital video data to the source voltage;

a switching circuit between the DAC and each data line to be operated by a control signal to connect each data line to the source line; and a multiplexer controller comprising a data reading unit to read image data on a per line basis, detect reference data which is a maximum value representing a gray level among the image data, a lookup table to store the reference data and a voltage level of the control signal in an associated manner, and a control signal output unit to select the voltage level of the control signal corresponding to the reference data from the lookup table and produce the control signal with the selected voltage that controls an operation timing of the switching circuit to connect each data line to the source line, wherein when the source voltage is a positive voltage, the multiplexer controller sets the voltage level of the control signal so that a turn-on level of the control signal is proportional to a value of the source voltage and lower than the first gate voltage and a turn-off level of the control signal is a negative voltage having an absolute value less than an absolute value of the second gate voltage.

2. The display device of claim 1, wherein the source line sequentially outputs data of first to third colors during one horizontal period, and wherein the data of the first to third colors is respectively supplied to different data lines.

3. The display device of claim 2, wherein first and second source lines respectively output data voltages of different polarities, and wherein the switching circuit alternately connects the data lines to a first and a second source lines.

4. The display device of claim 3, wherein the first and the second source lines sequentially output the data of the first to third colors during first to third scan periods, wherein the switching circuit includes a first switching element connecting the first source line to a first data line and a fourth switching element connecting the second source line to a fourth data line during the first scan period, wherein the switching circuit includes a second switching element connecting the second source line to a second data line and a fifth switching element connecting the first source line to a fifth data line during the second scan period, and wherein the switching circuit includes a third switching element connecting the first source line to a third data line and a sixth switching element connecting the second source line to a sixth data line during the third scan period.

5. The display device of claim 1, wherein when the source voltage is a negative voltage, the multiplexer controller sets the voltage level of the control signal so that an absolute value of the control signal is inversely proportional to an absolute value of the source voltage.

6. The display device of claim 1, wherein the multiplexer controller controls the voltage level of the control signal so that an absolute value of a low potential voltage level of the control signal when the source voltage is a positive voltage is less than an absolute value of a low potential voltage level of the control signal when the source voltage is a negative voltage.

7. A method of driving a display device including a display panel with a plurality of data lines and a plurality of gate lines, the method comprising;

reading image data on a per line basis and detecting reference data which is a maximum value representing a gray level among the image data, by a multiplexer controller;

converting the image data to a source voltage by a digital-to-analog converter (DAC) in a data driver;

supplying the source voltage corresponding the image data to each data line through a source line, by the data driver;

producing a control signal, a voltage level of which is determined based on the reference data, by the multiplexer controller; and controlling an operating time of a switching circuit by the control signal to connect the data line to the source line, wherein when the source voltage is a positive voltage, the voltage level of the control signal is set by the multiplexer controller so that a turn-on level of the control signal is proportional to a value of the source voltage and lower than a first gate voltage and a turn-off level of the control signal is a negative voltage having an absolute value less than an absolute value of a second gate voltage, the first gate voltage and the second gate voltage respectively being a gate high voltage and a gate low voltage of a gate pulse supplied to the plurality of gate lines, the gate low voltage being lower than the gate high voltage.

8. The method of claim 7, wherein the source line sequentially outputs data of first to third colors during one horizontal period, and wherein the data of the first to third colors is respectively supplied to different data lines.

9. The method of claim 8, wherein first and second source lines respectively output data voltages of different polarities, and wherein the switching circuit alternately connects the data lines to a first and a second source lines.

10. The method of claim 9, wherein the first and the second source lines sequentially output the data of the first to third colors during first to third scan periods, wherein the switching circuit includes a first switching element connecting the first source line to a first data line and a fourth switching element connecting the second source line to a fourth data line during the first scan period, wherein the switching circuit includes a second switching element connecting the second source line to a second data line and a fifth switching element connecting the first source line to a fifth data line during the second scan period, and wherein the switching circuit includes a third switching element connecting the first source line to a third data line and a sixth switching element connecting the second source line to a sixth data line during the third scan period.

11. The method of claim 7, wherein when the source voltage is a negative voltage, the multiplexer controller sets the voltage level of the control signal so that an absolute value of the control signal is inversely proportional to an absolute value of the source voltage.

12. The method of claim 7, wherein the multiplexer controller controls the voltage level of the control signal so that an absolute value of a low potential voltage level of the control signal when the source voltage is a positive voltage is less than an absolute value of a low potential voltage level of the control signal when the source voltage is a negative voltage.

* * * * *